United States Patent [19]

Rolle et al.

[11] Patent Number: 4,851,110

[45] Date of Patent: Jul. 25, 1989

[54] AIR PUMP SEPARATOR METHOD AND APPARATUS

[75] Inventors: Thomas E. Rolle; David J. Nebel; John L. Shulan; William P. Liljestrom, all of Dubuque, Iowa

[73] Assignee: T.D.J. Co., Inc., Dubuque, Iowa

[21] Appl. No.: 144,678

[22] Filed: Jan. 13, 1988

Related U.S. Application Data

[63] Continuation of Ser. No. 935,139, Nov. 28, 1986, abandoned, which is a continuation of Ser. No. 748,429, Jun. 25, 1985, abandoned.

[51] Int. Cl.[4] ..... B07B 4/00

[52] U.S. Cl. ..... 209/135; 209/142; 209/638; 209/639; 406/61

[58] Field of Search ..... 209/638, 639, 134–137, 209/142, 143, 154, 138, 139.1, 631; 406/6, 153, 93–95, 194, 154

[56] References Cited

U.S. PATENT DOCUMENTS

| | | | |
|---|---|---|---|
| 288,550 | 11/1883 | Coombes | 336/257 |
| 293,577 | 2/1884 | Howe | 239/209 |
| 933,532 | 9/1909 | Cooper | 209/142 |
| 1,359,496 | 11/1920 | Gasche | 209/135 |
| 1,502,050 | 7/1924 | Moore | 209/147 |
| 1,660,682 | 2/1928 | Stebbins | 209/145 |
| 2,403,740 | 7/1946 | Muench | 83/91 |
| 2,532,351 | 12/1950 | Wedebrock | 406/61 |
| 2,764,893 | 10/1956 | Falkenberg | 74/25 |
| 3,034,646 | 5/1962 | Eissmann et al. | 209/133 |
| 3,262,457 | 7/1966 | Gamberini | 209/137 X |
| 3,409,025 | 11/1968 | Wochnowski | 131/135 |
| 3,469,691 | 9/1969 | Boyce | 209/133 |
| 3,593,851 | 7/1971 | Davidson | 209/133 |
| 3,647,062 | 3/1972 | Cancel et al. | 209/133 |
| 3,738,483 | 6/1973 | MacKenzie | 209/638 X |
| 3,757,946 | 9/1973 | Berkowitz et al. | 209/631 X |
| 3,799,339 | 3/1974 | Breithdtz et al. | 209/135 X |
| 3,920,542 | 11/1975 | Laird et al. | 209/134 |
| 4,060,181 | 11/1977 | Grataloup | 406/93 |
| 4,089,422 | 5/1978 | Harmke et al. | 209/137 |
| 4,139,454 | 2/1979 | Larson | 209/12 |
| 4,222,858 | 9/1980 | Avila et al. | 209/11 |
| 4,242,197 | 12/1980 | Voelskow et al. | 209/3 |
| 4,405,451 | 9/1983 | Roman | 209/147 X |
| 4,500,228 | 2/1985 | McDonald et al. | 406/61 |
| 4,519,896 | 5/1985 | Vickery | 209/135 X |

FOREIGN PATENT DOCUMENTS

| | | | |
|---|---|---|---|
| 709975 | 7/1941 | Fed. Rep. of Germany | 209/135 |
| 24076 | 10/1962 | Fed. Rep. of Germany | 209/134 |
| 563929 | 12/1923 | France | 209/135 |
| 956056 | 9/1982 | U.S.S.R. | 209/135 |
| 1183200 | 10/1985 | U.S.S.R. | 209/134 |

*Primary Examiner*—Robert B. Reeves
*Assistant Examiner*—Donald T. Hajec

[57] ABSTRACT

A device and method for separating particles by mass is provided in which the particles are entrained in an airstream and are ejected into a collection zone where they will fall under the influence of gravity, but will separate longitudinally by mass with the most massive particles traveling the farthest. As an enhancement to the separation, an apparatus for forming at least one air curtain perpendicular to the ejection direction is provided which causes the falling particles to separate into discrete groups.

7 Claims, 3 Drawing Sheets

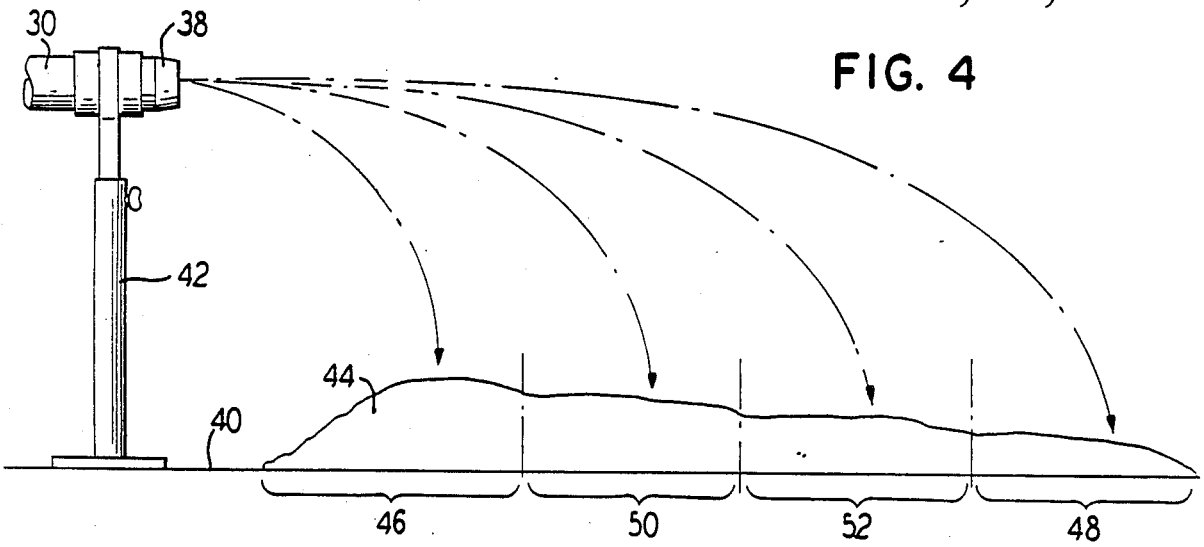
FIG. 4
FIG. 5
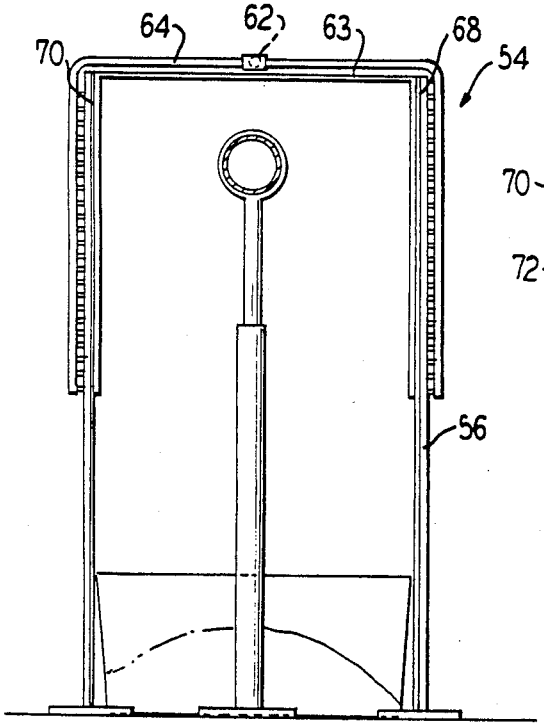
FIG. 8
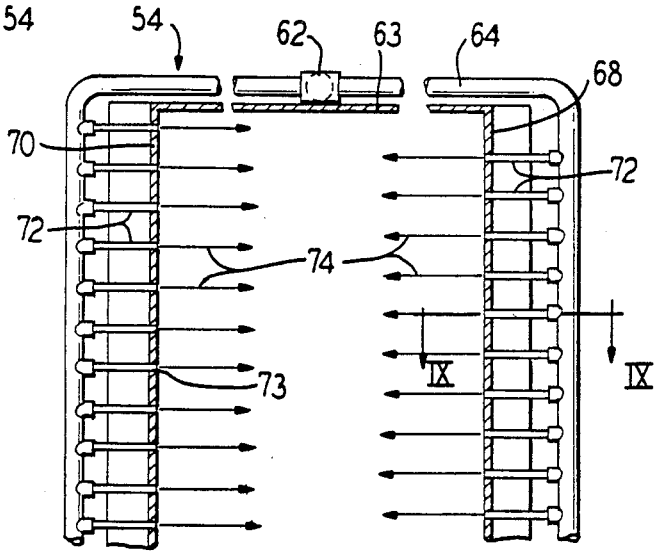
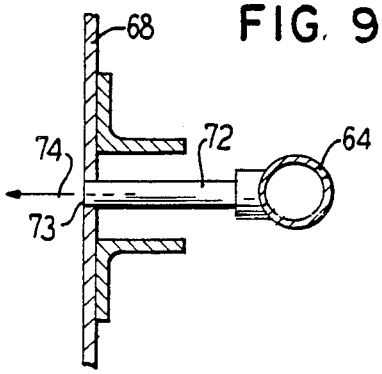
FIG. 9

AIR PUMP SEPARATOR METHOD AND APPARATUS

This is a continuation of application Ser. No. 935,139filed Nov. 28, 1986 which is a continuation of application Ser. No. 748,429, filed June 25, 1985 both now abandoned.

BACKGOUND OF THE INVENTION

1. Field of the Invention

The present invention relates to a device and method for separating solid materials according to mass by use of an air pump.

2. Description of the Prior Art

Devices and methods for separating materials by using airstreams are known which usually use the airstream to separate light materials from heavy materials in that the light materials are carried by the airstream and the heavy materials are uneffected by or dropped out of the airstream. For example, such devices are shown in U.S. Pat. Nos. 933,532 and 4,242,197. The prior art does not disclose devices or methods for separating materials according to mass by entraining all of the materials in an airstream at an equal velocity and using the resulting momentum of the particles to effect the separation. Further, the prior art does not disclose a method or apparatus for entrancing the separation by such a method incorporating the use of air knives.

SUMMARY OF THE INVENTION

The present invention provides a device and method for separating solid materials according to mass by incorporating all of the materials into an airstream such that all of the particles within the material will have substantially the same velocity and the ejecting the material from a nozzle whereby the material will fall under influence of gravity at various distances from the nozzle depending on the mass of the material. The greater the mass, the farther the material will travel from the nozzle.

Although the material will be separated generally according to its mass can be further utilized by separating various portions of an elongated pile extending from the nozzle, an additional apparatus and method is provided in a further embodiment of the invention in which a plurality of air curtains or air knives are used to separate the airborne particles into discrete piles. In accordance with this aspect of the invention, an air curtain is provided perpendicular to the direction of the airstream and causes a discrete cut off point at various locations for collecting particles within a discrete mass range.

The present invention can be used to separate and classify material and works especially well when the materials are generally of a similar size such that the materials will in fact be separated according to their specific gravity.

BRIEF DESCRIPTION OF THE DRAWINGS

FIG. 4 is a side elevational view of a nozzle and ejection pile.

FIG. 5 is a view taken generally along the line V—V of FIG. 6.

FIG. 8 is a sectional view taken generally along the line VIII—VIII of FIG. 7.

FIG. 9 is a partial sectional view taken generally along the line IX—IX of FIG. 8.

DETAILED DESCRIPTION OF THE PREFERRED EMBODIMENTS

Figure 1:
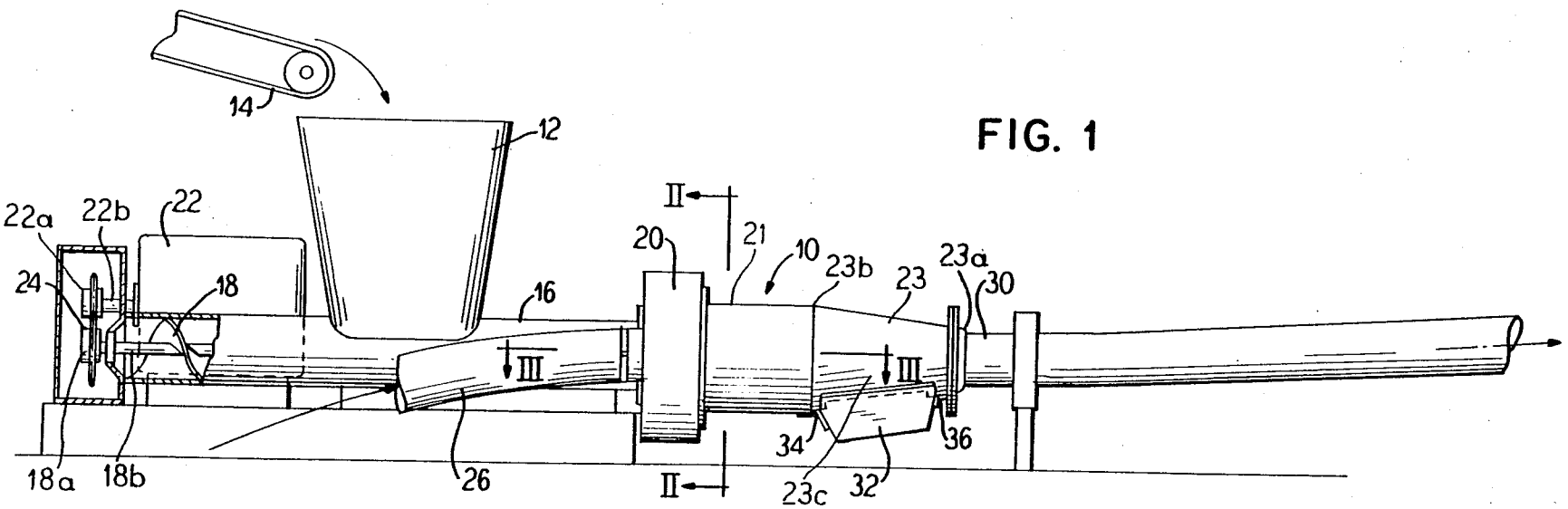
FIG. 1 is a side elevational view of an apparatus usable to entrain materials into an airstream.
Figure 2:
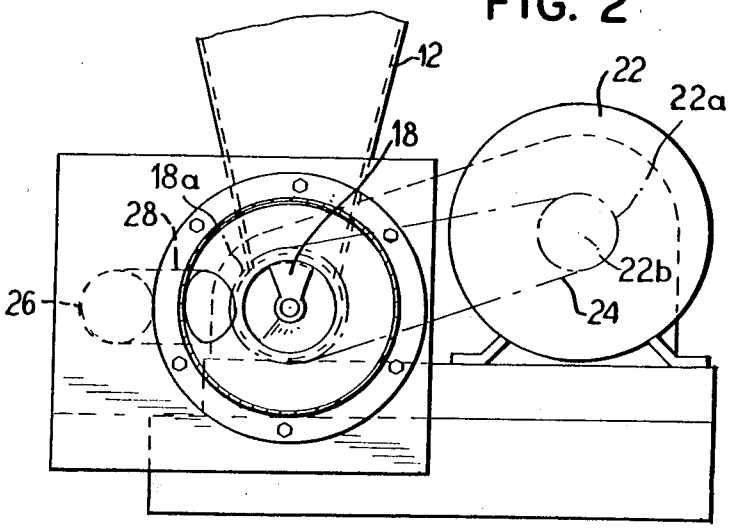
FIG. 2 is a sectional view taken in general along the line II—II of FIG. 1.
Figure 3:
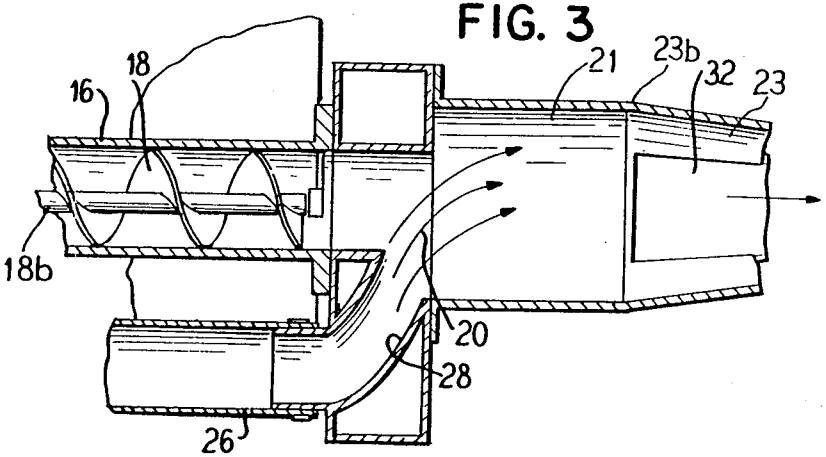
FIG. 3 is a sectional view taken generally along the line III—III of FIG. 1.

In FIGS. 1–3 there is shown an air pump generally at 10 which includes an inlet hopper 12 for receiving a supply of dry particulate material from a conveyor or chute 14. The hopper 12 opens at a bottom end into a horizontal tube 16 which has a material conveyor such as an auger 18 therein for moving the particulate material into a pickup chamber 20. The auger 18 is powered by an electrical motor 22 through an appropriate gear or pulley arrangement 24, including a pulley 18A coupled to auger shaft 18B and a pulley 22A coupled to motor shaft 22B.

As illustrated most clearly in FIGS. 1 and 2, the auger shaft **18*b* and motor shaft 22*b* are aligned in parallel fashion so that the gear or pulley arrangement 24 extends perpendicularly between the two. The auger 18 is such that, as illustrated in FIGS. 1 and 3, it extends into conduit 16, beneath hopper 12 so as to collect material from the bottom end of the hopper to carry the material to the pick-up chamber 20. Accordingly, as illustrated most clearly in FIG. 3, the auger 18 and its shaft 18*b* extend beyond both sides of the bottom end of the feeder hopper 12 but terminate just prior to the pick-up chamber 20**.

An air supply conduit 26 is connected to the pickup chamber 20 and has an inlet 28 to the chamber 20 directed at an oblique angle to the direction of the infeed of materials in order to agitate and pick up the materials into the airstream. As such, the inlet 28 comprises a means for mixing the particulate materials within the air stream such that the materials are entrained in the air stream. The materials picked up in pickup chamber 20 are then carried into mixing chamber 21 where they are further entrained in the airstream. Upon exiting the mixing chamber 21, the material laden airstream is accelerated within acceleration chamber 23 connected thereto. Because of its tapered construction (an outlet diameter **23*a* being less than an inlet diameter 23*b*), the acceleration chamber 23 will cause the entrained materials to travel at a faster and equal velocity. As illustrated, the mixing chamber is formed as a straight cylinder while the acceleration chamber has a conical shape imparted by tapering of its sidewall 23C. The particulate laden airstream then exits from the acceleration chamber 23 and passes into an exit or exhaust conduit 30** to be directed to a further discharge point.

An openable collection chamber 32 is provided downstream of the pickup chamber upon a tapered side or wall **23*c* of acceleration chamber 23 for the collection of particulate matter which is too heavy for the airstream to carry. The chamber has a hinge 34 on one side and a latch 36** on an opposite side to permit the opening and sealing of the chamber as required.

The air pump illustrated is only representative of a number of similar devices which can be utilized in accordance with the present invention. The requirement for the pump is that it be able to entrain the particulate material into the airstream and to carry the particulate material at a predetermined or preselected velocity.

FIG. 4 shows a first embodiment of the invention in which the discharge conduit 30 has a discharge end 38 supported above ground level 40 by a support member 42. The particulate material which has been picked up by the airstream is carried through the discharge conduit 30 at a constant velocity and all of the particulate material within the airstream has substantially the same velocity. The discharge end 38 comprises a discharge means for discharging the particulate laden airstream from the air pump. As the material exits the discharge opening 38, the airstream dissipates and the material is caused to fall downwardly under the influence of gravity. It has been discovered that the material will fall into an elongated pile 44 in which a first segment 46 will comprise the least massive (lightest) particulate material and a most distant segment 48 will comprise the most massive (heaviest) particulate material and intervening segments 50, 52 will comprise particulate materials having successively increasing mass. The pile will be a continuous elongated pile unless the particulate material is substantially equal in size and is comprised of a mixture of particles with widely different specific gravities.

The principle behind the separation in this method is that a momentum is imparted to the particulate material, momentum being the product of mass and velocity. Since all of the particulate material has the same velocity, the material having a higher mass will have a higher momentum and thus will travel farther from the discharge outlet 38 as described above.

This method can be used to separate and classify materials according to their mass and further can be used to separate and classify materials according to their specific gravity particularly where the size of the particles are substantially equal. Thus, materials of a particular specific gravity will fall a particular distance from the outlet opening and thus can be easily identified and separated. If the particulate materials are within a small range of sizes, they can also be separated by using the disclosed method although there may be some overlap between successive areas.

To enhance the separation of materials, a further embodiment of the present invention is illustrated in FIGS. 5–9. In this embodiment, an air curtain or air knife separator device 54 is utilized to provide discrete collection zones for the particulate material. The air knife separator 54 is independent from the discharge conduit but it is placed closely adjacent the discharge opening 38.

The air knife device 54 is comprised of an elongated box-like frame which is open at at least a first end 58 to receive the stream of particulate material.

To supply the air knife or air curtain function, a blower 60 is connected to an air conduit manifold 62 that extends longitudinally along a closed top wall 63 of the frame. A plurality of conduits 64 tap into the manifold and extend laterally across the top wall 63 and extend downwardly along opposite enclosed side walls 68, 70 a portion of the height of the frame. The side walls 68, 70 are closed at a top portion to prevent interference with or disturbance of the particulate laden air stream as it passes through the separator device. The side walls 68, 70 are open at a bottom portion to permit air to escape from the enclosure as it dissipates.

As the side conduits 64 extend downwardly along the sides 68, 70 of the separator device, a plurality of tubes 72 tap into the lines 64 and extend through the side walls 68, 70 at open ends 73. Thus, jets of air indicated by arrows 74 in FIGS. 8 and 9 form an air curtain at selected longitudinal positions along the length of the separator device 54. As illustrated, the jets of air 74 are directed horizontally, and because of the linear vertical arrangement of same, the air curtains formed by the air jets are vertically oriented. This air curtain forms a barrier perpendicular to the direction of the particulate laden air stream which can be penetrated only by particles having a momentum of some predetermined amount or greater. Thus, all particles having a momentum less than the selected value are stopped by the air curtain and fall into a collection bin 76 for further use.

The airborne particulate matter passing through the first air curtain then proceeds toward the next air curtain, the momentum of all particles decreasing due to decreasing velocity with the additional distance. Again, the particles having smaller momentum are separated from those having a higher momentum and a second discrete pile can be collected.

The number and placement of the air curtains can be selectively determined based on the mix of materials being separated and the particular mass of the materials as well as the airstream velocity.

Figure 6:
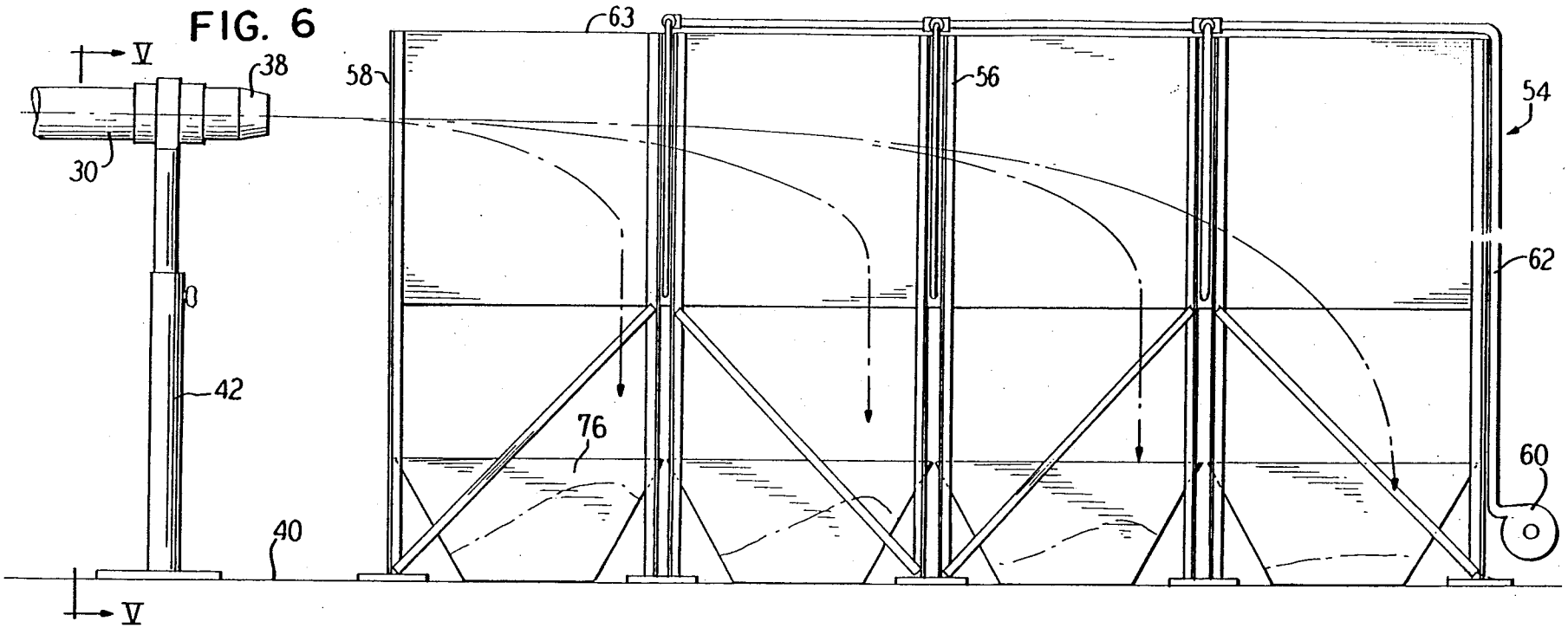
FIG. 6 is a side elevational view of an air curtain separator device.
Figure 7:
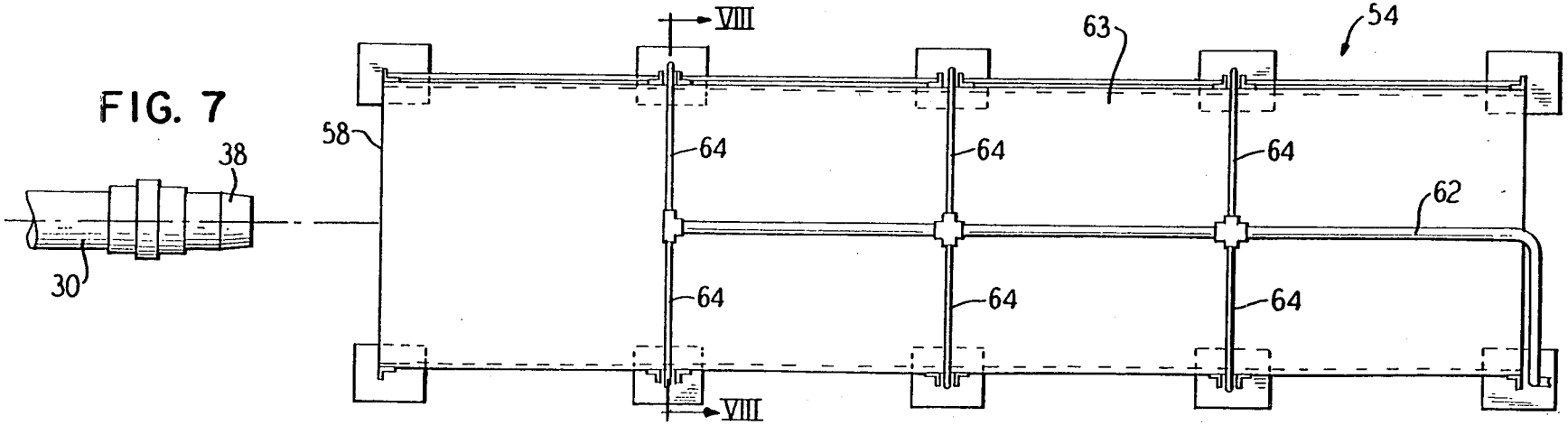
FIG. 7 is a top elevational view of the device shown in FIG. 6.

As seen in FIG. 6, the particulate matter falls into distinct piles due to the action of the air knives as opposed to a single elongated pile as seen in FIG. 4. Thus, the separation and classification of the materials can proceed more accurately by use of the air knives.

The method and apparatus of this invention finds particular use in separating heterogeneous materials such as sand mixed with small metallic particles and small organic and inorganic materials such as would be obtained in a final screen separator step as disclosed in my U.S. Pat. application No. 4,648,650 patent application entitled "SCREEN SEPARATOR METHOD FOR FOUNDRY WASTE MATERIALS". By the use of the present invention additional recyclable materials can be separated and reclaimed from the "waste sand" output disclosed in that application which comprises a heterogeneous mixture of particles less than $\frac{1}{4}$ to $\frac{1}{8}$ inches in diameter.

The usefulness of the present invention is by no means limited to such use in that it can be used to separate or classify a wide array of materials by size if homogeneous or by weight if heterogeneous and of equal size, but always by mass regardless of size or homogeneity.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as my invention:

1. A method of separating particulate matter by mass comprising the following steps:

conveying a supply of said particulate matter into a feeder hopper;

feeding said particulate matter in said feeder hopper into a first conduit containing an auger, said auger having a shaft;

driving said auger with a motor having a shaft extending parallel to the shaft of said auger, the auger being driven by a belt extending between a first pulley located on the motor shaft and a second pulley located on the auger shaft;

supplying an air stream at an inlet located at a discharge end of said auger relative to the conduit, which inlet lies in a horizontal plane;

picking up particulate matter in said airstream;

mixing said particulate matter with said airstream within a straight cylinder mixing chamber communicating with a downstream end of said conduit so as to entrain said matter within said airstream;

accelerating said material laden airstream within a conical acceleration chamber communicating with a downstream end of said mixing chamber so as to increase and equalize velocities of individual pieces of particulate matter;

collecting particulate matter within said acceleration chamber which does not become entrained in said airstream from a side of said acceleration chamber;

discharging said particulate laden airstream along a horizontal path from an open end of a second conduit communicating with a discharge end of said acceleration chamber into a collection zone;

forming at least one air curtain by injecting air from a plurality of vertically aligned, horizontally directed air jets;

separating the particulate matter downstream from the open end of the second conduit into discrete portions by positioning at least one air curtain perpendicular to the discharge direction at selected locations along the discharge flow path; and collecting discrete portions of the particulate matter from the collection zone for further utilization;

whereby said particulate matter will be separated in said collection zone with the more massive particulate matter traveling further from the open end of said conduit than the less massive particulate matter.

2. An apparatus for separating particulate matter by mass comprising:

a feeder hopper for feeding a supply of particulate matter, said feeder hopper having an inlet end and a discharge end;

an auger located in a conduit beneath said feeder hopper, said conduit having a top opening communicating with said discharge end of said feeder hopper, said auger having two ends each of which extends beyond said discharge end of said feeder hopper;

a drive system for driving said auger comprising a motor having a shaft extending parallel to a shaft of said auger, a pulley located on each of said shafts, and a drive belt extending between said pulleys;

an airstream inlet communicating with said conduit and located at a discharge end of said auger, said auger and auger shaft terminating prior to said airstream inlet;

an airstream flowing into said conduit through said airstream inlet for picking up particulate matter within said airstream;

a straight cylinder-shaped mixing chamber coupled to the discharge end of said auger within which said particulate matter is mixed within said airstream so as to entrain said particulate matter within said airstream; and a conically-shaped conduit acceleration chamber coupled to an outlet of said mixing chamber within which said particulate laden airstream is accelerated;

a collection bin located on a tapered wall of said conically-shaped conduit and in communication with the interior thereof for capturing particulate matter not entrained in said airstream;

a conduit coupled to an outlet of said acceleration chamber and having a discharge end;

a collection zone for collecting particulate matter dropping out of said airstream upon exiting of said airstream from the discharge end of said conduit; and at least one air curtain formed by a plurality of vertically aligned, horizontally directed air jets, said air curtain positioned perpendicularly to the discharge path of the particulate laden air stream.

3. An apparatus for separating particulate matter by mass comprising:

means for delivering a supply of particulate matter to a horizontal cylindrical conduit, an auger feeder located within said conduit for conveying said particulate matter into a pick-up chamber, said auger feeder having two ends, each of which extends beyond a discharge outlet of said means for delivering a supply of particulate matter;

means for driving said auger comprising a motor having a shaft positioned parallel to a shaft of said auger, a first pulley located on an end of said motor shaft, a second pulley located on an end of said auger, and a drive belt extending between said first and second pulleys;

means for supplying an airstream through an inlet at an angle relative to said pick-up chamber, which inlet lies in a horizontal plane and is located at a discharge end of said auger feeder, said auger and auger shaft terminating prior to said inlet;

means for causing said airstream to pick up particulate matter discharged from said auger feeder;

means located downstream of said auger feeder comprising a straight cylinder for mixing said picked-up particulate matter within said airstream so as to entrain a major portion of said particulate matter within said air stream;

means for accelerating said particulate laden airstream comprising a conically-shaped conduit located downstream of said means for mixing;

means for collecting and removing particulate matter from said conically-shaped conduit which is not entrained in said airstream located on a tapered wall of said conically-shaped conduit;

means for horizontally discharging said particulate laden airstream from said conically-shaped conduit into a collection zone; and means for collecting discrete portions of said particulate matter from said collection zone for further utilization comprising air curtains formed by vertically aligned, horizonally directed air jets positioned at selected locations along the discharge flow path perpendicular to the discharge direction;

whereby, said discharge particulate matter is separated into discrete areas of more massive particulate matter and areas of less massive particulate matter as they fall into the collection zone under the influence of gravity.

4. An apparatus according to claim 3 wherein said means for accelerating said particulate laden airstream comprises a chamber having tapered sides and said collecting and removing means comprises an openable collection chamber located on a tapered side of said acceleration chamber.

5. An apparatus for separating particulate matter by mass comprising:

a feeder hopper for receiving a supply of particulate matter, said feeder hopper having an inlet and a discharge end with two sides;

a conduit oriented horizontally and having a top opening communicating with said discharge end of said feeder hopper;

an auger and a shaft thereof located in a sectional portion of said conduit for conveying particulate matter from said hopper and discharging the particulate matter into a pickup portion of said conduit at an end of said auger, said auger extending beyond both sides of the discharge end of said feeder hopper, said auger and auger shaft terminating prior to said pickup portion;

a motor having a shaft extending therefrom with a first pulley located thereon;

a belt drive extending from said first pulley to a second pulley located on the auger shaft;

an airstream supplied through an inlet at an angle relative to the conduit, which inlet lies in a horizontal plane and which is located at a discharge end of said auger;

a pickup chamber located at said discharge end of said auger and communicating therewith in which said airstream picks up particulate matter discharged by said auger;

a straight cylinder-shaped mixing chamber located at a downstream side of said pickup chamber and communicating therewith in which said particulate matter is mixed with said airstream so as to entrain particulate matter in said airstream, all of said airstream being directed into said mixing chamber;

a conically-shaped acceleration chamber located downstream of said mixing chamber and communicating therewith in which said particulate laden airstream is subject to an increase in velocity;

a collection chamber located on a conical wall of said acceleration chamber and communicating with said acceleration chamber to collect particulate matter not entrained in said airstream;

a discharge conduit located downstream of said acceleration chamber and communicating therewith from which said particulate laden air stream is discharged;

a collection zone; and at least one air curtain formed in said collection zone perpendicular to the discharge flow path of said material laden airstream by a plurality of vertically aligned, horizontally directed air jets;

whereby, said airstream carries said entrained particulate matter out of an open end of said conduit into said collection zone such that the particulate matter travels in a horizontal path through each air curtain formed by said horizontally aligned air jets so that the more massive particulate matter is carried further than the less massive particulate matter with said air curtain segregating said particulate matter into discrete portions.

6. An apparatus according to claim 5 wherein said means for forming an air curtain comprises:

a box-like frame member with an open end for receiving said particulate laden air stream;

an air blower;

an air manifold connected to said blower; and a plurality of air conduits connected to said manifold having openings directed towards the interior of said frame member perpendicular to the discharge direction of said air stream.

7. An apparatus according to claim 5, including a plurality of container means for receiving said separated particulate matter in said collection zone.

* * * * *